United States Patent [19]

Lybrook et al.

[11] Patent Number: 4,731,847

[45] Date of Patent: Mar. 15, 1988

[54] ELECTRONIC APPARATUS FOR SIMULATING SINGING OF SONG

[75] Inventors: Gilbert A. Lybrook; Kun-Shan Lin; Gene A. Frantz, all of Lubbock

[73] Assignee: Texas Instruments Incorporated, Dallas, Tex.

[21] Appl. No.: 372,257

[22] Filed: Apr. 26, 1982

[51] Int. Cl.[4] ..... G10L 5/00

[52] U.S. Cl. ..... 381/51; 84/1.01

[58] Field of Search ..... 381/51–53; 84/1.01, 1.03; 364/513.5

[56] References Cited

U.S. PATENT DOCUMENTS

| | | | |
|---|---|---|---|
| 3,632,887 | 1/1972 | Leipp | 381/52 |
| 3,704,345 | 11/1972 | Coker | 381/52 |
| 4,206,675 | 6/1980 | Gooch | 84/1.03 |
| 4,278,838 | 7/1981 | Antonov | 381/52 |
| 4,281,577 | 8/1981 | Middleton | 84/454 |
| 4,321,853 | 3/1982 | Tumblin | 84/454 |
| 4,342,023 | 7/1982 | Tsunoda et al. | 381/51 |
| 4,441,399 | 4/1984 | Wiggins et al. | 84/470 R |

*Primary Examiner*—Emanuel S. Kemeny

*Attorney, Agent, or Firm*—William E. Hiller; N. Rhys Merrett; Melvin Sharp

[57] ABSTRACT

An electronic apparatus in which the operator inputs both the textual material and a sequence of pitches which upon synthesization simulates singing qualities. The operator inputs a textual material, typically through a keyboard arrangement, and also a sequence of pitches as the tune of the desired song. The text is broken into syllable components which are matched to each note of the tune. The syllables are used to generate control parameters for the synthesizer from their allophonic components. The invention allows the entry of text and a pitch sequence so as to simulate electronically the singing of a tune.

21 Claims, 10 Drawing Figures

| 201 NOTES | 202 FIRST OCTAVE (HZ) | 203 SECOND OCTAVE (HZ) | 204 THIRD OCTAVE (HZ) | 205 FOURTH OCTAVE (HZ) |
|---|---|---|---|---|
| C | 66 | 131 | 262 | 523 |
| CS | 69 | 139 | 277 | 554 |
| D | 74 | 147 | 294 | ⋮ |
| DS | 78 | 156 | 311 | |
| E | 83 | 165 | 330 | |
| F | 87 | 175 | 349 | |
| 206 FS | 207 93 | 185 | 370 208 | |
| G | 98 | 196 | 392 | |
| GS | 104 | 208 | 416 | |
| A | 110 | 220 | 440 | |
| AS | 117 | 233 | 466 | |
| B | 124 | 247 | 494 | |

ELECTRONIC APPARATUS FOR SIMULATING SINGING OF SONG

BACKGROUND

This invention relates generally to speech synthesizers and more particularly to synthesizers capable of simulating a singing operation.

With the introduction of synthesized speech has come the realization that electronic speech is a necessary and desirable characteristic for many applications. Synthesized speech has proved particularly beneficial in the learning aid application since it encourages the student to continually test the limits of his/her knowledge. Additionally, the learning aid environment allows the student to pace himself without fear of recrimination or peer pressure.

Learning aids equipped with a speech synthesis capability are particularly appropriate for the study of the rudimentary skills. In the area of reading, writing, and arithmetic, they have proven to be especially well accepted and beneficial. Beyond the rudimentary skills though, and particularly with respect to the arts, speech synthesis generally has remained a technological curiosity.

Due to technological limitations, the use of synthesized speech has been effectively prevented from application in the musical domain. Synthesized speech is typically robotic and tends to have a mechanical quality to its sound. This quality is particularly undesirable in the singing application.

No device currently allows for the effective use of synthesized speech in an application involving singing ability.

SUMMARY OF THE INVENTION

The present invention allows for operator input of a sequence of words and a sequence of pitch data into an electronic apparatus for the purpose of simulating the singing of a song. The sequence of words is broken into a sequence of syllables which are matched to the sequence of pitch data. This combination is used to derive a sequence of synthesis control data which when applied to a synthesizer generates an auditory signal which varies in pitch so as to simulate a singing operation.

Although the present invention speaks in terms of inputting a sequence of "words", it is intended that this limitation allows the input of an allophonic textual string or the like. This flexibility allows the input of an alpha-numeric string which is indicative of a particular allophone sequence which generates sounds.

In a preferred embodiment of the invention, the operator enters, typically via a keyboard, a sequence of words constituting a text. This text is translated to a sequence of allophones through the use of a text-to-allophone rule library. The allophones are then grouped into a sequence of syllables.

Each syllable is combined with an associated pitch and preferably a duration. The syllable is translated to a sequence of linear predictive coding (LPC) parameters which constitute the allophones within the syllable. The parameters are combined with a pitch and duration to constitute synthesis control commands.

These synthesis control commands control the operation of a synthesizer, preferably a linear predictive synthesizer, in the generation of an auditory signal in the form of song.

The translation of text to speech is well known in the art and is described in length in the article "Text-to-Speech Using LPC Allophone Stringing" appearing in *IEEE Transactions on Consumer Electronics,* Vol. CE-27, May 1981, by Kun-Shan Lin et al. The Lin et al article describes a low cost voice system which performs text-to-speech conversion utilizing an English language text. In the operation it converts a string of ASCII characters into their allophonic codes. LPC parameters matching the allophonic code are then accessed from an allophone library so as to produce natural sounding speech. The Lin et al article is incorporated hereinto by reference.

Alternatively, the text may be introduced into the electronic apparatus via a speech recognition apparatus. This allows the operator to verbally state the words, have the apparatus recognize the words so entered, and operate upon these words. Speech recognition apparatuses are well known in the art.

Although this application utilizes words as being enterable, it is intended that any representations of human sounds, including but not limited to numerals and allophones, are enterable as defining the text. In this context, a representation of human sounds includes an identification of a particular lyric.

Although the preferred embodiment of the invention allows for the entry of pitch data via a dedicated key pad upon the apparatus, an alternative embodiment utilizes a microphone into which the operator hums or sings a tune. This tune has extracted from it an associated pitch sequence. Defined therein are both the necessary pitches and durations associated therewith.

A suitable technique for extracting pitches from an analog signal is described by Joseph N. Maksym in his article "Real-Time Pitch Extraction by Adaptive Prediction of the Speech-Waveform", appearing in *IEEE Transactions on Audio and Electroacoustics,* Vol. AU-21, Number 3, June 1973, incorporated hereinto by reference. The Maksym article determines the pitch period by a non-stationary error process which results from an adaptive-predictive quantization of speech. It also describes in detail the hardware necessary so as to implement the apparatus in a low cost embodiment.

As noted before, the preferred embodiment allows for operator entry of the pitch and preferable duration, via a key pad, which is in association with the keyboard used for entry of the textual material. This allows for easy operator entry of the data which is later combined with the parameters associated with each syllable within the textual material to form synthesis control commands.

One such suitable synthesizer technique is described in the article "Speech Synthesis" by M. R. Buric et al appearing in the *Bell System Technical Journal,* Vol. 60, No. 7 September 1981, pages 1621–1631, incorporated hereinto by reference. The Buric article describes a device for synthesizing speech using a digital signal processor chip. The synthesizer of the Buric et al article utilizes a linear dynamic system approximation of the vocal tract.

Another suitable synthesizer is described in U.S. Pat. No. 4,209,844, entitled "Lattice Filter for Waveform or Speech Synthesis Circuits Using Digital Logic", issued to Brantingham et al on June 24, 1980 incorporated hereinto by reference. The Brantingham et al patent describes a digital filter for use in circuits for generating complex wave forms for the synthesis of human speech.

Since the operator is permitted to define the pitch sequence, either through direct entry or by referencing a tune from memory, the syllable synthesized therefrom carries with it the tonal qualities desired. A sequence of synthesized syllables therefore imitates the original tune.

Since both the text and the pitch are definable by the operator, experimentation through editing of the text or pitch sequence is readily achieved. In creating a composition, the artist is permitted to vary the tune or words at will until the output satisfies the artist.

Another embodiment of the invention allows the operator to select a prestored tune from memory, such as a read only-memory, and create lyrics to fit The invention and embodiments thereof are more fully explained by the following drawings and their accompanying descriptions.

DRAWINGS IN BRIEF

FIGS. *3a, 3b,* and *3c* are block diagrams of alternative embodiments for the generation of pitch sequences.

Figure 4:
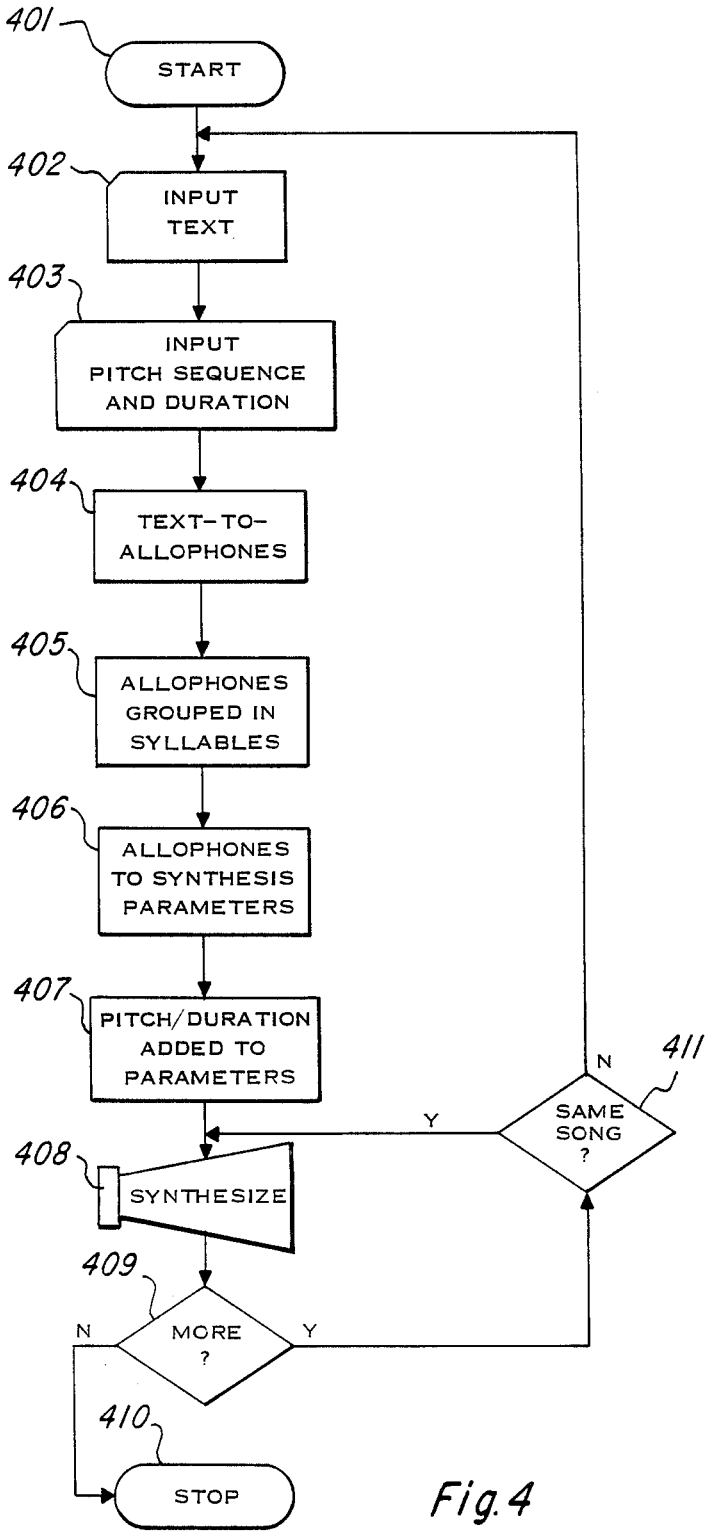

FIG. 4 is a flow chart embodiment of data entry.

Figure 5:
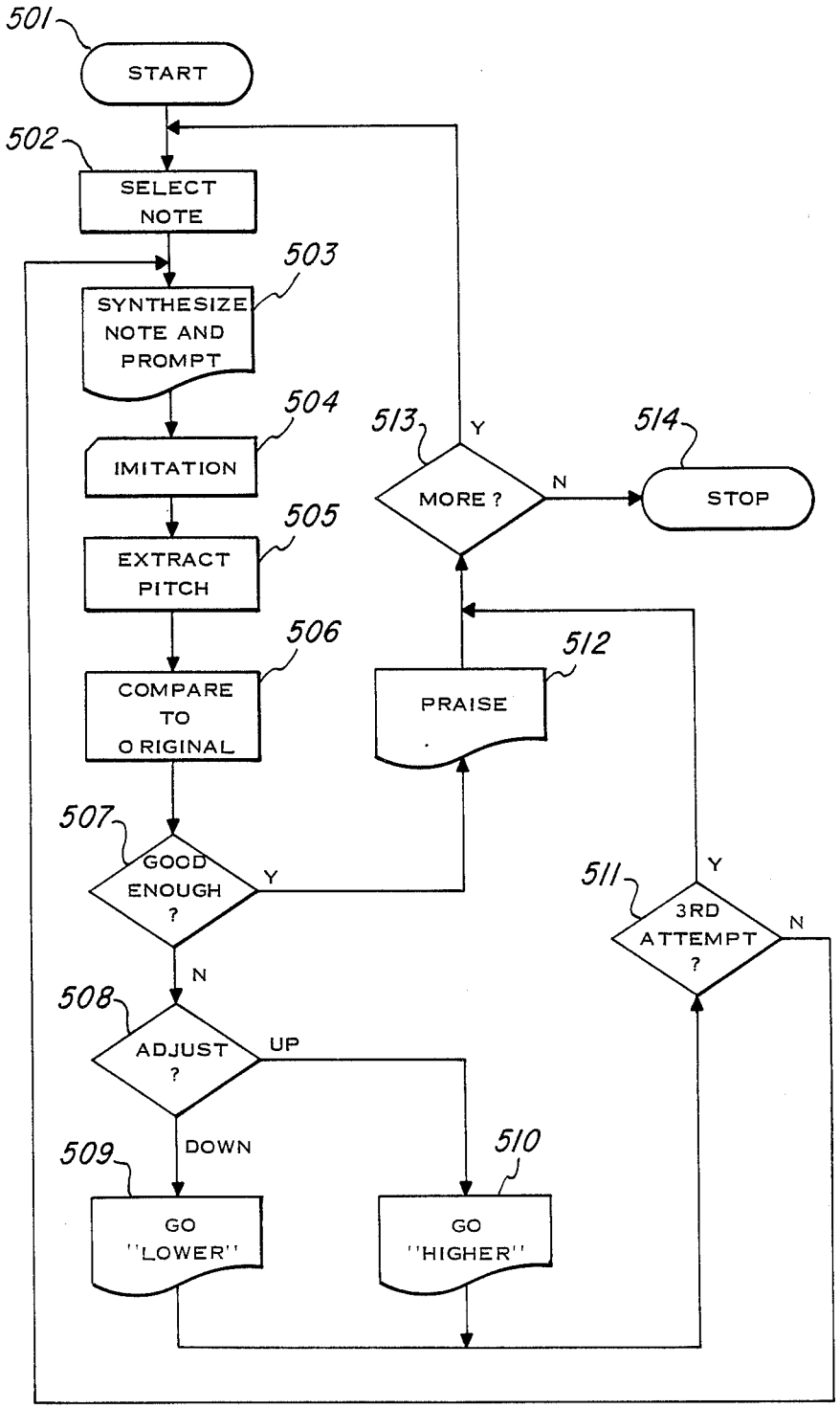

FIG. 5 is a flow chart of a learning aid arrangement of the present invention.

Figure 6:
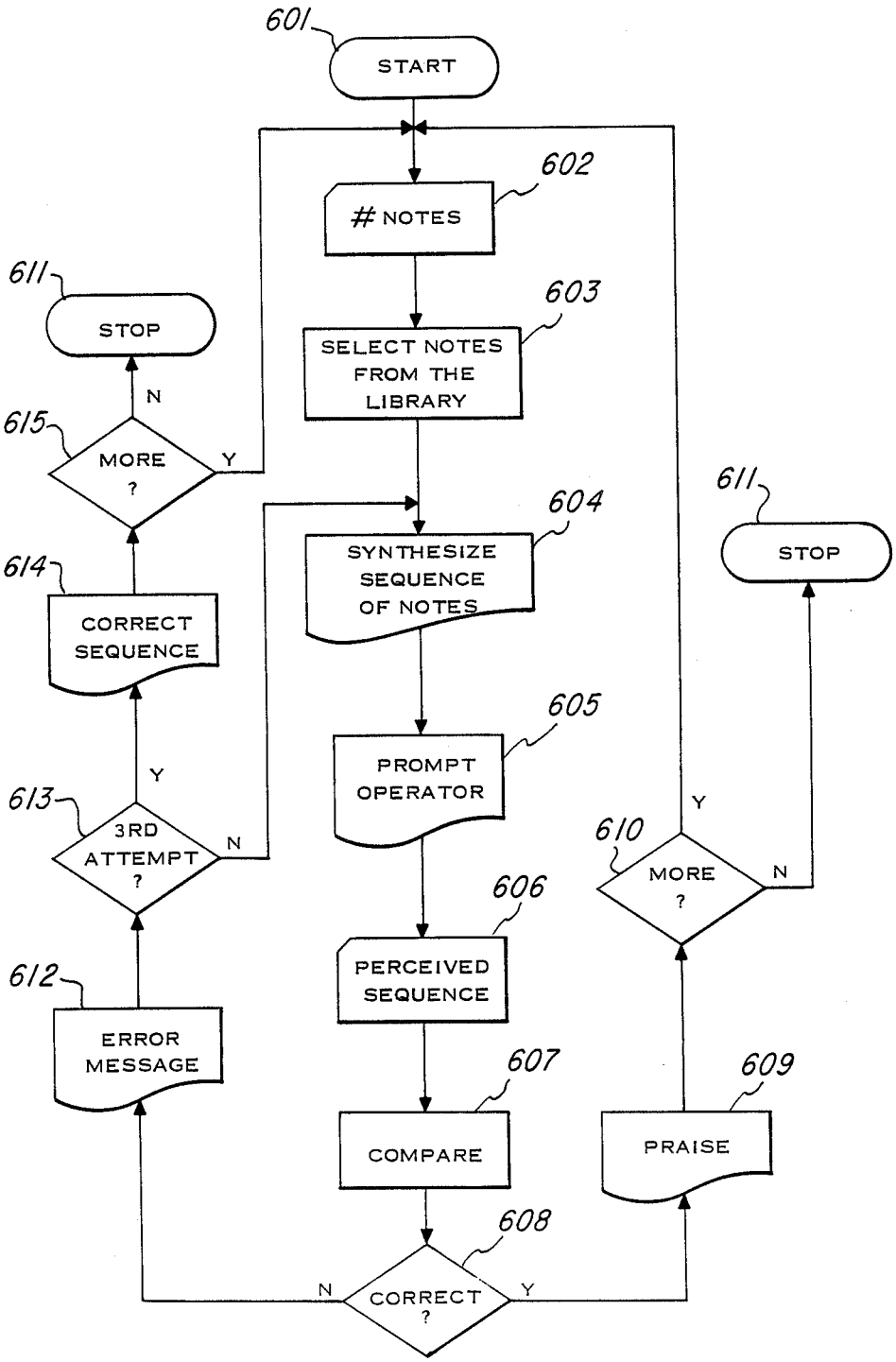
Figure 7A:
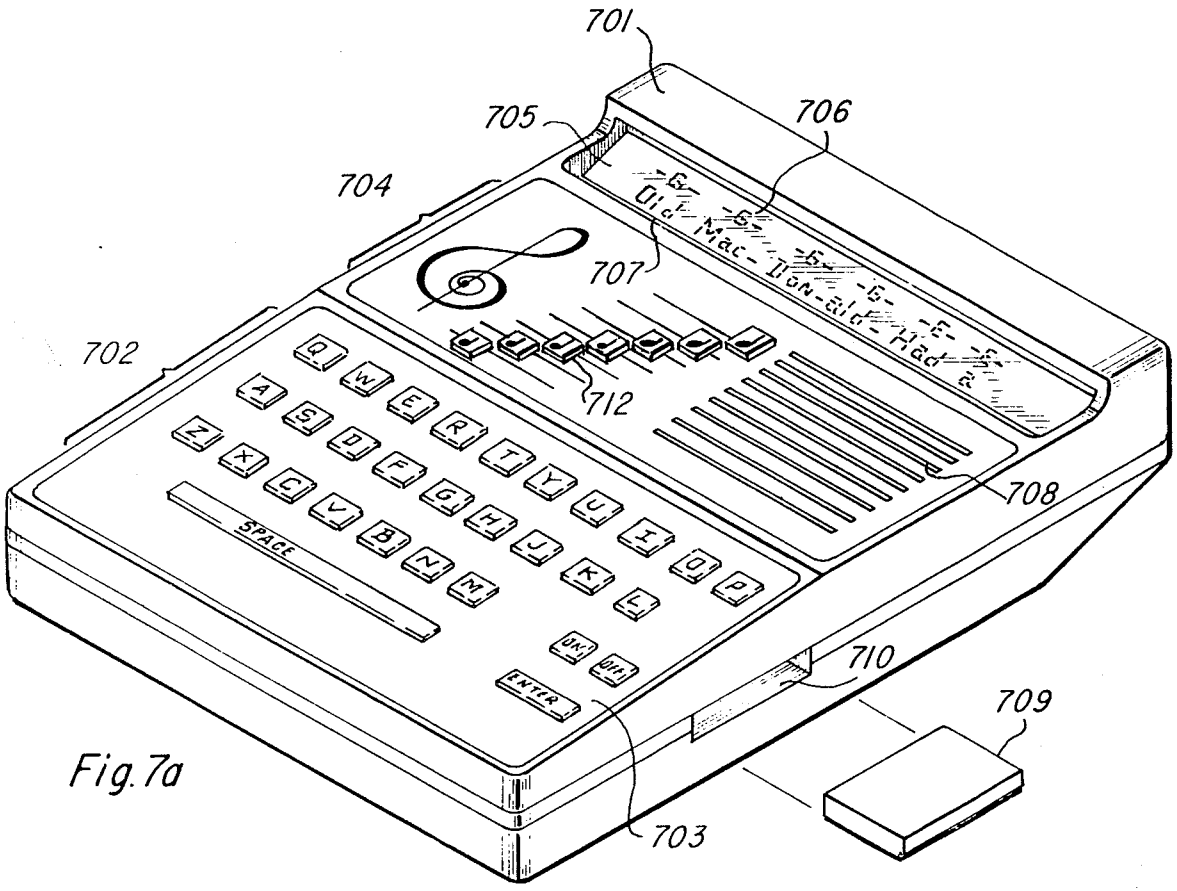
Figure 7B:
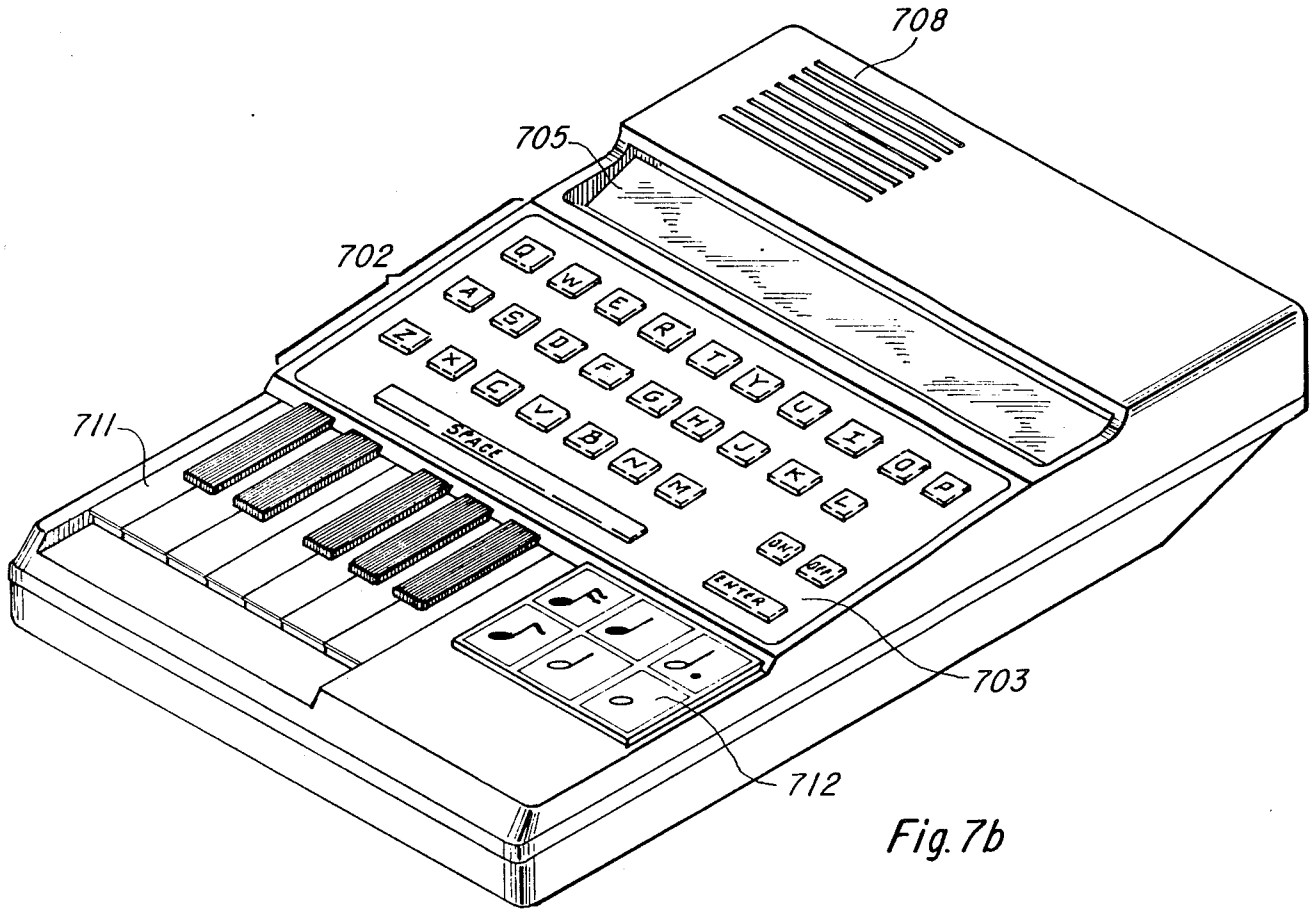

FIG. 6 is a flow chart of a musical game of one embodiment of the invention.

FIGS. *7a* and *7b* are pictorial representations of two embodiments of the invention.

DRAWINGS IN DETAIL

Figures 1, 2:
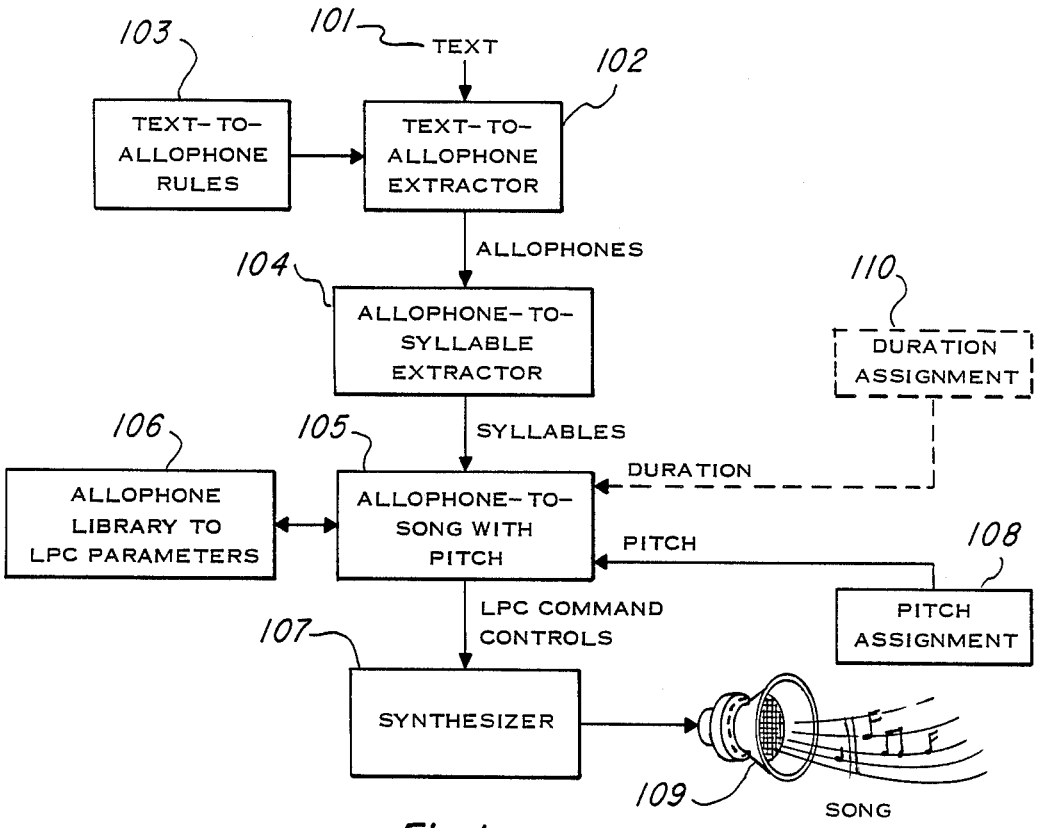
FIG. 1 is a block diagram of an embodiment of the invention.
FIG. 2 is a table of frequencies associated with the musical notes.
Figure 3A:
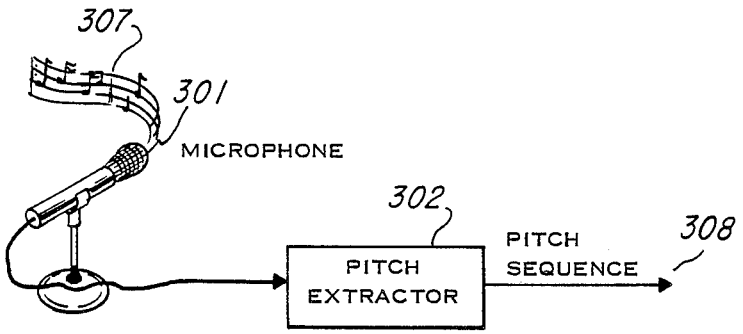
Figure 3B:
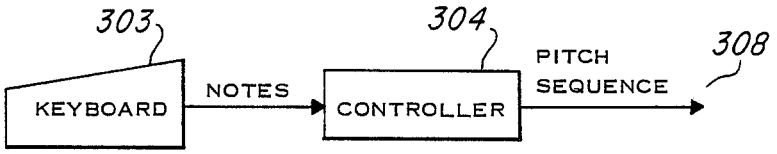
Figure 3C:
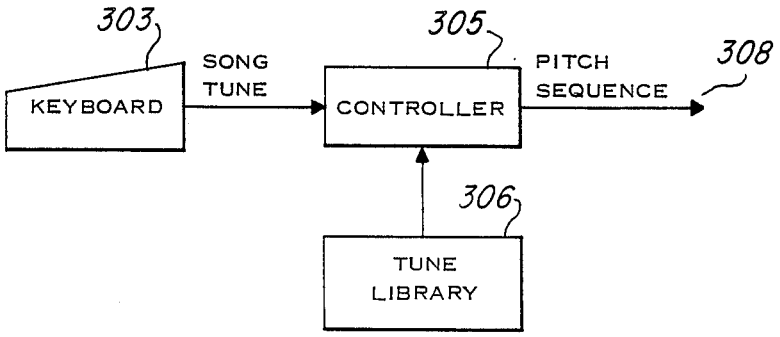

FIG. 1 is a block diagram of an embodiment of the invention. Textual material 101 is communicated to a text-to-allophone extractor 102. The allophone extractor 102 utilizes the allophone rules 103 from the memory. The allophone rules 103, together with the text 101 generate a sequence of allophones which is communicated to the allophone-to-syllable extractor 104.

The syllable extractor 104 generates a sequence of syllables which is communicated to the allophone-to-song with pitch determiner 105. The song with pitch determiner 105 utilizes the sequence of syllables and matches them with their appropriate LPC parameters 106. This, together with the pitch from the pitch assignment 108, generates the LPC command controls. Preferably, a duration from the duration assignment 110 is also associated with the LPC command controls which are communicated to the synthesizer 107.

The LPC command controls effectively operate the synthesizer 107 and generate an analog signal which is communicated to a speaker 109 for the generation of the song.

In this fashion, a textual string is communicated together with pitch and preferably duration, by the operator to the electronic apparatus for the synthesis of an auditory signal which simulates the singing operation.

FIG. 2 is a table of the frequencies for the classical musical notes. The notes 201 each have a frequency (Hz) for each of the octaves associated therewith.

As indicated by the table, the first octave 202, the second octave 203, the third octave 204, and the fourth octave 205 each have associated with it a particular frequency band range. Within each band range, a particular note has the frequency indicated so as to properly simulate that note. For example, an "fs" (F-Sharp), 206, has a frequency of 93 Hz, 207, in the first octave 202 and a frequency of 370 Hz, 208, in the third octave 204.

It will be understood that the assignment of frequencies to each of the notes within each of the octaves is not absolute and is chosen so as to create a pleasing sound.

FIGS. *3a, 3b,* and *3c* are block diagrams of embodiments of the invention for the generation of a pitch sequence. In FIG. *3a,* the operator sings a song or tune 307 to the microphone 301.

Microphone 301 communicates its electronic signal to the pitch extractor 302. The pitch extractor generates a sequence of pitches 308 which is used as described in FIG. 1.

In FIG. *3b,* the operator inputs data via a keyboard 303. This data describes a sequence of notes. These notes are indicative of the frequency which the operator has chosen. The frequency and note correlation were described with reference to FIG. 2. The notes are communicated to a controller 304 which utilizes them in establishing the frequency desired in generating a pitch 308 therefrom.

In FIG. *3c,* the operator chooses a specific song tune via the keyboard 303. This song tune identification is utilized by the controller 305 with the tune library 306 in establishing the sequence of pitches which have been chosen. In this embodiment, the operator is able to choose typical or popular songs with which the operator is familiar. For example, the repertoire of songs for a child might include "Mary had a Little Lamb", "Twinkle, Twinkle Little Star", etc. Each song tune has an associated pitch sequence and duration which is communicated, as at 308, to be utilized as described in FIG. 1.

In any of these embodiments, the operator is able to select the particular pitch sequence which is to be associated with the operator entered textual material for the simulation of a song.

FIG. 4 is a flow chart embodiment of the data entry to the electronic apparatus. Start 401 allows for the input of the text 402 by the operator. Following the input of the text 402, the operator inputs the pitch sequence desired and the associated duration sequence 403. All of this data is used by the text-to-allophone operation 404.

The allophones included in the sequence of allophones so derived are grouped into syllables 405, and the synthesis parameters associated with each of the allophones 406, are derived. The pitch and duration are added to the parameters 407 to generate synthesis control commands which are used to synthesize 408, the "song like" imitation.

A determination is made if the operator wants to continue in the operation 409. If the operator does not want to continue, a termination or stop 410 is made; otherwise, the operator is queried as to whether he desires to hear the same song 411 again. If the same song is desired, the synthesizer 408 is again activated using the synthesis control commands already derived; otherwise the operation returns to accept textual input or to edit (not shown) already entered textual input 402.

In this manner the operator is able to input a text and pitch sequence, listen to the results therefrom, and edit either the text, pitch, or duration at will so as to evaluate the resulting synthesized song imitation.

FIG. 5 is a flow chart diagram of an embodiment of the invention for teaching the operator respective notes and their pitch. After the start 501, a note is selected by the apparatus from the memory 502. This note is synthesized and a prompt message is given to the operator 503, to encourage the operator to hum or whistle the note.

The operator attempts an imitation 504 from which the pitch is extracted 505. The operator's imitation pitch is compared to the original pitch 506, and a determination is made if the imitation is of sufficient quality 507. If the quality is appropriate, a praise message 512 is given; otherwise a determination is made as to what adjustment the operator is to make. If the operator's imitation is too high, a message "go lower" 509 is given to the operator; otherwise a message "go higher" 510 is given.

If the instant attempt by the operator to imitate the note is less than the third attempt at imitating the note 511, the note is again synthesized and the operator is again prompted 503; otherwise the operator is queried as to whether he desires to continue with more testing 513. If the operator does not wish to continue, the operation stops 514; otherwise a new note is selected 502.

It will be understood from the foregoing that the present operation allows for the selection of a note, the attempted imitation by the operator, and a judgment by the electronic apparatus as to the appropriateness of the operator's imitation. In the same manner, a sequence of notes constituting a tune may be judged and tested.

FIG. 6 is a flow chart of a game operation of one embodiment of the invention. After the start 601, the operator selects the number of notes 602 which are to constitute the test.

The apparatus selects the notes from the library 603, which are synthesized 604 for the operator memory. The operator is prompted 605 to imitate the notes so synthesized. The operator imitates his preceived sequence 606, after which the device compares the imitation with the original to see if it is correct 608. If it is not correct, an error message 612 is given; otherwise a praise message 609 is given.

After the praise message 609, the operator is queried as to whether more operations are desired. If the operator does not desire to continue, the operation stops 611; otherwise the operator enters the number of notes for the new test.

After an error message 612, a determination is made as to whether the current attempt is the third attempt by the operator to imitate the number of notes. If the current attempt is less than the third attempt, the sequence of notes is synthesized again for operator evaluation 604; otherwise the correct sequence is given to the operator and a query is made as to whether the operator desires to continue the operation. If the operator does not want to continue, the operation stops 611; otherwise the operator enters the number of notes 602 to form the new test.

In this embodiment of the invention, two or more players are allowed to enter the number of notes which they are to attempt to imitate in a game type arrangement. Each operator is given three attempts and is judged thereupon. It is possible for the operators to choose the number of notes in a challenging arrangement.

FIGS. *7a* and *7b* are pictorial arrangements of embodiments of the invention.

Referring to FIG. *7a*, an electronic apparatus in accordance with the present invention comprises a housing 701 on which a keyboard 702 is provided for entry of the textual material. A set of function keys 703 allows for the operator activation of the electronic apparatus, the entry of data, and deactivation. A second keyboard 704 is also provided on the housing 701. The keyboard 704 has individual keys 712 which allow the entry of pitch data by the operator. To enter the pitch data, the operator depresses a key 712 indicating a pitch associated with the note "D", for example.

A visual display is disposed above the two keyboards 702, 704 on the housing 701 and allows for the visual feedback of the textual material entered, broken down into its syllable sequence 707 and associated pitches 706. The visual display 705 allows for easy editing by the operator as a particular syllable or word together with the pitch and duration therewith.

A speaker/microphone 708 allows for entry of auditory pitches and for the output of the synthesized song imitation. In addition, a sidewall of the housing 701 is provided with a slot 710 which defines an electrical socket for accepting a plug-in-module 709 for expansion of the repertoire of songs or tunes which are addressable by the operator via the keyboard 702. A read-only-memory (ROM) is particularly beneficial in this context since it allows for ready expansion of the repertoire of tunes which are readily addressable by the operator.

FIG. *7b* is a second pictorial representation of an embodiment of the invention. The embodiment of FIG. *7b* contains the same textual keyboard 702, display 705, microphone/speaker 708 and function key set 703. The entry in this embodiment though of the pitch and duration is by way of a stylized keyboard 711.

Keyboard 711 is shaped in the form of a piano keyboard so as to encourage interaction with the artistic community. As the operator depresses a particular key associated with a pitch on the keyboard 711, the length of time the key is depressed is illustrated by the display 712. Display 712 contains numerous durational indicators which are lit from below depending upon the duration of key depression of the keyboard 711. Hence, both pitch and duration are communicated at a single key depression. An alternative to display 712 is the use of a liquid crystal display (LCD) of a type known in the art.

It will be understood from the foregoing, that the present invention allows for operator entry and creation of a synthesized song imitation through operator selection of both text and pitch sequences.

What is claimed is:

1. An electronic sound synthesis apparatus for simulating the vocal singing of a song, said apparatus comprising:

operator input means for selectively introducing a sequence of textual information representative of human sounds and for establishing a sequence of pitch information;

memory means storing digital data therein representative of at least portions of words in a human language from which the lyrics of a song may be synthesized, said memory means further including a storage portion in which digital data representative of a plurality of pitches is stored from which the tune of a song may be synthesized;

control means operably coupled to said operator input means and said memory means for forming a sequence of synthesis control data in response to the accessing of digital data representative of at least portions of words and the accessing of digital data representative of a selected sequence of pitches defining a tune, said control means including correlation means for combining the sequences of digital data from said memory means respectively representative of the lyrics and the tune of the song in a manner producing said sequence of synthesis control data;

synthesizer means operably associated with said memory means and said control means for receiving said sequence of synthesis control data as produced by said correlation means and providing an analog output signal representative of the song as produced by the lyrics and tune; and audio means coupled to said synthesizer means for converting said analog output signal into an audible song comprising the lyrics and the tune in a correlated relationship.

2. An electronic sound synthesis apparatus as set forth in claim 1, wherein said operator input means is further effective for establishing duration information corresponding to each of the pitches included in the sequence of pitch information;

the storage portion of said memory means in which digital data representative of a plurality of pitches is stored further storing digital data representative of a plurality of different durations to which any one of the plurality of pitches may correspond from which the tune of the song may be synthesized; and said sequence of synthesis control data being formed by said control means in further response to the accessing of digital data representative of selected durations corresponding respectively to the individual pitches included in the selected sequence of pitches defining a tune such that the duration information corresponding to each of the pitches included in the sequence of pitches is included in said sequence of synthesis control data produced by said correlation means.

3. An electronic sound synthesis apparatus as set forth in claim 1, wherein said operator input means comprises keyboard means for selectively introducing at least textual information.

4. An electronic sound synthesis apparatus as set forth in claim 3, wherein said keyboard means includes a first keyboard including a plurality of keys respectively representative of letters of the alphabet and adapted to be selectively actuated by an operator in the introduction of the sequence of textual information, and a second keyboard including a plurality of keys respectively representative of individual pitch-defining musical notes and adapted to be selectively actuated by the operator in establishing the sequence of pitch information.

5. An electronic sound synthesis apparatus as set forth in claim 4, wherein said second keyboard is arranged in the form of a piano-like keyboard.

6. An electronic sound synthesis apparatus as set forth in claim 1, wherein said storage portion included in said memory means in which digital data representative of a plurality of pitches is stored comprises a tune library in which a plurality of predetermined tunes as defined by respective selective arrangements of pluralities of pitch sequences are stored;

said operator input means including a keyboard having a plurality of keys for selective actuation by an operator so as to identify respective predetermined tunes as stored in said tune library of said memory means; and said control means accessing digital data representative of a selected sequence of pitches defining said tune from said tune library as identified by the selective key actuation of said keyboard by the operator such that said correlation means of said control means is effective for combining the sequence of digital data from said memory means representative of the lyrics with the digital data from said tune library of said memory means representative of the selected tune in producing said sequence of synthesis control data.

7. An electronic sound synthesis apparatus as set forth in claim 1, further including means operably coupled to said operator input means for receiving said sequence of textual information therefrom and establishing a sequence of syllables corresponding to said sequence of textual information;

said correlation means of said control means matching each syllable from said sequence of syllables with a corresponding pitch from said sequence of pitches in combining the sequences of digital data from said memory means respectively representative of the lyrics and the tune of the song for producing said sequence of synthesis control data.

8. An electronic sound synthesis apparatus as set forth in claim 7, wherein said means for establishing said sequence of syllables from said sequence of textual information includes means for forming a sequence of allophones as digital signals identifying the respective allophone subset variants of each of the recognized phonemes in a given spoken language as modified by the speech environment in which the particular phoneme occurs from said sequence of textual information, and means for grouping the allophones in the sequence of allophones into said sequence of syllables.

9. An electronic sound synthesis apparatus as set forth in claim 2, further including allophone rule means having a plurality of allophonic signals corresponding to digital characters representative of textual information, wherein the allophonic signals are determinative of the respective allophone subset variants of each of the recognized phonemes in a given spoken language as modified by the speech environment in which the particular phoneme occurs;

allophone rules processor means having an input for receiving the sequence of textual information from said operator input means and operably coupled to said allophone rule means for searching the allophone rule means to provide an allophonic signal output corresponding to the digital characters representative of the sequence of textual information from the allophonic signals of said allophone rule means;

syllable extraction means coupled to said allophone rules processor means for receiving said allophonic signal output therefrom and grouping the allophones into a sequence of syllables corresponding to said allophonic signal output; and said control means combining each syllable of said sequence of syllables with digital data corresponding to an associated pitch and duration in forming said sequence of synthesis control data.

10. An electronic sound synthesis apparatus as set forth in claim 9, further including allophone library means in which digital signals representative of allophone-defining speech parameters identifying the respective allophone subset variants of each of the recognized phonemes in a given spoken language as modified by the speech environment in which the particular phoneme occurs are stored, said allophone library means being operably coupled to said control means and providing digital signals representative of the particular allophone-defining speech parameters corresponding to the sequence of syllables; and the digital data corresponding to respective pitches and their associated durations being provided in the form of digital signals designating pitch and duration parameters and being combined by said control means with said digital signals representative of the particular allophone-defining speech parameters corresponding to the sequence of syllables in forming said sequence of synthesis control data.

11. An electronic sound synthesis apparatus as set forth in claim 10, wherein said digital signals representative of the particular allophone-defining speech parameters corresponding to the sequence of syllables and said digital signals designating pitch and duration parameters are linear predictive coding parameters such that said sequence of synthesis control data is in the form of linear predictive coding digital signal parameters; and said synthesizer means being a linear predictive coding synthesizer.

12. An electronic sound synthesis apparatus for simulating the vocal singing of a song, said apparatus comprising:

operator input means for selectively introducing a sequence of textual information representative of human sounds and for establishing a sequence of pitch information;

memory means storing digital data therein representative of at least portions of words in a human language from which the lyrics of a song may be synthesized;

pitch determination means operably associated with said operator input means and responsive to the establishment of the sequence of pitch information for providing digital data representative of the sequence of pitches from which the tune of a song may be synthesized;

control means operably coupled to said operator input means, said memory means and said pitch determination means for forming a sequence of synthesis control data in response to the accessing of digital data representative of at least portions of words and the accessing of digital data representative of the sequence of pitches defining a tune, said control means including correlation means for combining the sequences of digital data from said memory means and said pitch determination means respectively representative of the lyrics and the tune of the song in a manner producing said sequence of synthesis control data;

synthesizer means operably associated with said memory means and said control means for receiving said sequence of synthesis control data as produced by said correlation means and providing an analog output signal representative of the song as produced by the lyrics and tune; and audio means coupled to said synthesizer means for converting said analog output signal into an audible song comprising the lyrics and the tune in a correlated relationship.

13. An electronic sound synthesis apparatus as set forth in claim 12, wherein said operator input means includes keyboard means for selectively introducing at least textual information.

14. An electronic sound synthesis apparatus as set forth in claim 12, wherein said operator input means is further effective for establishing duration information corresponding to each of the pitches included in the sequence of pitch information;

said pitch determination means being further responsive to the establishment of the respective durations corresponding to individual pitches included in the sequence of pitch information for providing digital data representative of the respective durations for each of the pitches included in the sequence of pitches from which the tune of the song may be synthesized; and said digital data representative of the duration information for each of the pitches included in the sequence of pitches being incorporated into said sequence of synthesis control data as produced by said correlation means of said control means.

15. An electronic sound synthesis apparatus as set forth in claim 14, wherein said operator input means at least includes a microphone for receiving an operator input as an operator-generated sequence of tones, said microphone generating an electrical analog output signal in response to said operator-generated sequence of tones; and said pitch determination means comprising pitch extractor means operably associated with said microphone for acting upon said electrical analog output signal therefrom to identify the sequence of pitches and durations associated therewith corresponding to the operator-generated sequence of tones and providing digital data representative of the sequence of pitches and associated durations from which the tune of the song may be synthesized.

16. An electronic sound synthesis apparatus as set forth in claim 15, wherein said operator input means further includes a keyboard having a plurality of keys respectively representative of letters of the alphabet and adapted to be selectively actuated by an operator in the introduction of the sequence of textual information.

17. An electronic sound synthesis apparatus as set forth in claim 12, further including means operably coupled to said operator input means for receiving said sequence of textual information therefrom and establishing a sequence of syllables corresponding to said sequence of textual information;

said correlation means of said control means matching each syllable from said sequence of syllables with a corresponding pitch from said sequence of pitches in combining the sequences of digital data from said memory means and said pitch determination means respectively representative of the lyrics and the tune of the song for producing said sequence of synthesis control data.

18. An electronic sound synthesis apparatus as set forth in claim 17, wherein said means for establishing said sequence of syllables from said sequence of textual information includes means for forming a sequence of allophones as digital signals identifying the respective allophone subset variants of each of the recognized phonemes in a given spoken language as modified by the speech environment in which the particular phoneme occurs from said sequence of textual information, and means for grouping the allophones in the sequence of allophones into said sequence of syllables.

19. An electronic sound synthesis apparatus as set forth in claim 14, further including allophone rule means having a plurality of allophonic signals corresponding to digital characters representative of textual information, wherein the allophonic signals are determinative of the respective allophone subset variants of each of the recognized phonemes in a given spoken language as modified by the speech environment in which the particular phoneme occurs;

allophone rules processor means having an input for receiving the sequence of textual information from said operator input means and operably coupled to said allophone rule means for searching the allophone rule means to provide an allophonic signal output corresponding to the digital characters representative of the sequence of textual information from the allophonic signals of said allophone rule means;

syllable extraction means coupled to said allophone rules processor means for receiving said allophonic signal output therefrom and grouping the allophones into a sequence of syllables corresponding to said allophonic signal output; and said control means combining each syllable of said sequence of syllables with digital data corresponding to an associated pitch and duration in forming said sequence of synthesis control data.

20. An electronic sound synthesis apparatus as set forth in claim 19, further including allophone library means in which digital signals representative of allophone-defining speech parameters identifying the respective allophone subset variants of each of the recognized phonemes in a given spoken language as modified by the speech environment in which the particular phoneme occurs are stored, said allophone library means being operably coupled to said control means and providing digital signals representative of the particular allophone-defining speech parameters corresponding to the sequence of syllables; and the digital data corresponding to respective pitches and their associated durations being provided in the form of digital signals designating pitch and duration parameters and being combined by said control means with said digital signals representative of the particular allophone-defining speech parameters corresponding to the sequence of syllables in forming said sequence of synthesis control data.

21. An electronic sound synthesis apparatus as set forth in claim 20, wherein said digital signals representative of the particular allophone-defining speech parameters corresponding to the sequence of syllables and said digital signals designating pitch and duration parameters are linear predictive coding parameters such that said sequence of synthesis control data is in the form of linear predictive coding digital signal parameters; and said synthesizer means being a linear predictive coding synthesizer.

* * * * *